US006973800B2

(12) United States Patent
Chuang et al.

(10) Patent No.: US 6,973,800 B2
(45) **Date of Patent: *Dec. 13, 2005**

(54) DISPLAY CASE AIR DUCT PARTITIONED FOR INDIVIDUAL FANS

(75) Inventors: Sue-Li Kingsley Chuang, Glastonbury, CT (US); Eugene Duane Daddis, Jr., Manlius, NY (US)

(73) Assignee: Carrier Commercial Refrigeration, Inc., Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/801,105

(22) Filed: Mar. 15, 2004

(65) Prior Publication Data

US 2004/0172961 A1 Sep. 9, 2004

Related U.S. Application Data

(63) Continuation of application No. 10/265,018, filed on Oct. 4, 2002, now Pat. No. 6,755,042.

(51) Int. Cl.[7] ..... A47F 3/04
(52) U.S. Cl. ..... 62/256; 62/426; 454/193
(58) Field of Search ..... 62/256, 426, 427; 454/193, 251, 338

(56) References Cited

U.S. PATENT DOCUMENTS

| | | | | |
|---|---|---|---|---|
| 2,262,477 | A | 11/1941 | Taugher | |
| 2,890,573 | A | 6/1959 | Lamb | |
| 3,528,258 | A | 9/1970 | Brennan | |
| 4,369,632 | A | 1/1983 | Abraham | |
| 4,608,835 | A | 9/1986 | Kooy | |
| 5,086,627 | A * | 2/1992 | Borgen | 62/229 |
| 5,755,108 | A | 5/1998 | Ibrahim et al. | |
| 6,755,042 | B2 * | 6/2004 | Chuang et al. | 62/256 |

OTHER PUBLICATIONS

U.S. Appl. No. 10/185,222, filed Jun. 27, 2002.
U.S. Appl. No. 09/844,939, filed Apr. 27, 2001.
AMCA International's Supplement to ASHRAE Journal, p. 43, Nov. 2001.

* cited by examiner

*Primary Examiner*—William E. Tapolcai
(74) *Attorney, Agent, or Firm*—Carlson, Gaskey & Olds

(57) ABSTRACT

A refrigeration system comprises a display case having a viewing area with the first side and a second side. An air outlet on the first side guides air across the viewing area to an air inlet on the second side. A first fan and a second fan communicate with the air inlet. A volume extends between the air inlet and the first and second fans. The partition divides this volume between the first and second fan.

18 Claims, 2 Drawing Sheets

DISPLAY CASE AIR DUCT PARTITIONED FOR INDIVIDUAL FANS

CROSS REFERENCE TO RELATED APPLICATIONS

This application is a continuation of U.S. Nonprovisional patent application Ser. No. 10/265,018 filed on Oct. 4, 2002 now U.S. Pat. No 6,755,042.

BACKGROUND OF THE INVENTION

This invention relates to a refrigerated display case.

Typically, a refrigerated display case includes a cold air discharge at one end of the case that blows cold air from the back of the case to the front of the case and over products contained therein. In addition, there is a diffuser at the top of the display case near the front that discharges cold air across the front opening of the display case. The diffuser includes a plurality of guide structures, known as straws, disposed to direct the flow of air perpendicular down the front opening of the display case. Cold air then flows to a warm air return at the bottom of the case, flowing back through a cooling circuit and out again through the cold air discharge.

Fans generally move the air through the cooling circuit. These fans are located near the bottom of the display case and draw air from the diffuser at the top of the display case to the warm air return at the bottom of the case. Usually, at least two fans are used to draw air into the warm air return from the diffuser. These fans spin generally in the same direction, say counterclockwise, on a panel that supports the fans within the case. When the fans spin in the same direction, air tends to build up over one of the fans due to the common direction of rotation of each fan. For example, fans spinning in a counterclockwise direction will build air over the left fan.

The build up of air over the fan results in the oscillation and fluctuation of air flow and an uneven air curtain across the viewing area as one side of the display case tends to receive more air than the other. Such a design is undesirable, resulting in inferior cooling of product contained within the display case as well as inefficient refrigeration. A need therefore exists for a refrigerated display case that moves air through the cooling circuit without this build up.

SUMMARY OF THE INVENTION

In contrast to existing refrigerated display cases, the inventive display case employs fans partitioned from each other so that air from one fan will not interfere with operation of the other fan. The partition may extend from the air inlet to the fans and downstream of the fans. Consequently, air is distributed more evenly through the cooling circuit, resulting in a uniform air curtain and efficient refrigeration.

The inventive refrigeration system comprises a display case having a viewing area with a first side and a second side. On one side, an air outlet directs air across the viewing area to an air inlet on the other side. In this way, an air curtain is formed. Air is drawn into the air inlet by a first and second fan. The first and second fan are spaced from the inlet to form a volume. A partition is formed between the first and second fan dividing the volume.

A cooling element, such as a refrigeration coil, may be spaced from the fans and may create another volume between the fans and the cooling element. Another partition may divide this other volume to further promote equal distribution of air through the display case. This partition may be used in conjunction with the partition between air inlet and fans.

The fans may be supported by a panel within the display case. Each of the partitions may extend perpendicularly from the panel. A second panel may serve as a cover and form a portion of the volume between the air inlet and the fan panel. The fans may further spin in the same direction.

In this way, each partition may form a wall with the fan panel. Thus, air within each chamber formed by each partition may avoid interfering with air in the other chamber. The refrigeration system avoids air build up over any one fan in an inexpensive manner.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
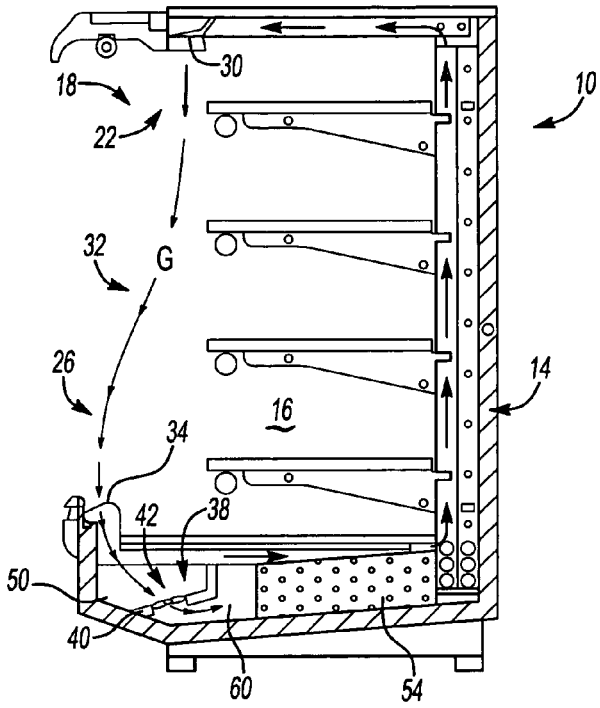
FIG. 1 illustrates a side view of display case, including first partition and second partition.
Figure 2:
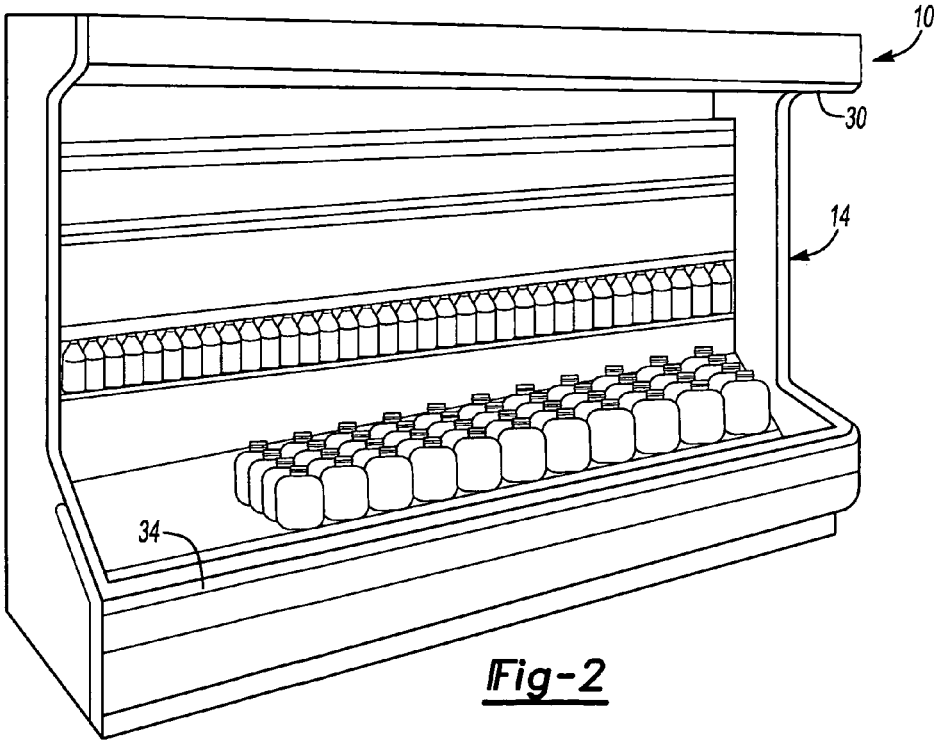
FIG. 2 illustrates a perspective view of the display case.

FIG. 1 illustrates a side view of refrigeration system 10, comprising display case 14 with first side 22, say a top, and second side 26, say a bottom. An area between first side 22 and second side 26 is open so as to create an open viewing area 18 that permits an individual to retrieve product contained within display case 14. To maintain a cool temperature within display case 14, air outlet 30 directs air along path G to air inlet 34, a warm air return, thereby forming air curtain 32. Air is returned to air inlet 34 and ultimately drawn by fans 38 and 42 over cooling element 54, such as a refrigeration coil, shown schematically, and then directed again to air outlet 30 as part of a cooling circuit cycle. As shown in FIG. 2, refrigeration system 10 has air outlet 30 extending over width of display case 14 to air inlet 34 found at the bottom of display case 14. These features of refrigeration system 10 are well known.

Figure 3:
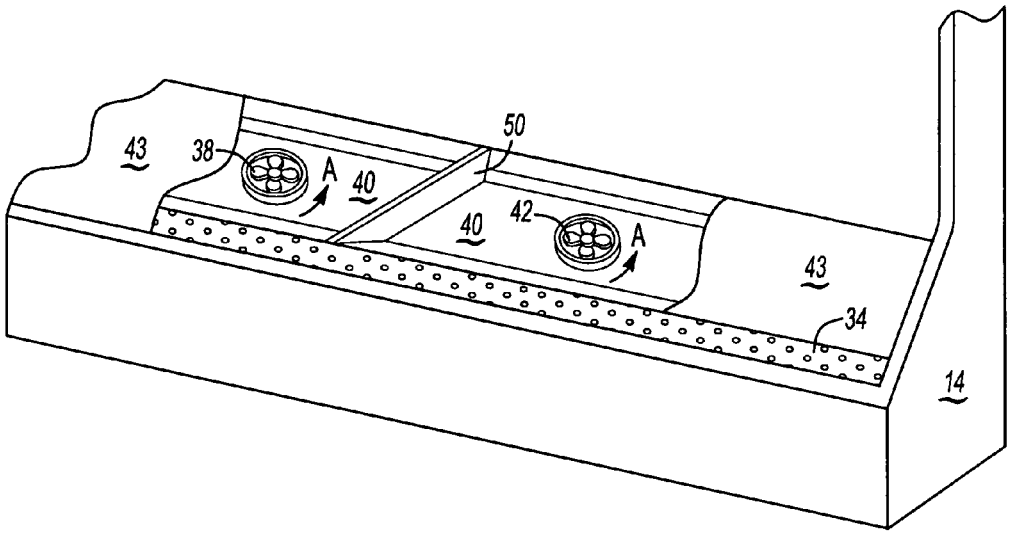
FIG. 3 illustrates a perspective view of first fan and second fan and partition.

In contrast to these known features, refrigeration system 10 has partitions 50, 60 that prevent airflow from fan 38 from interfering with airflow from fan 42. As shown in FIG. 3, fan 38 and fan 42 spin in a counterclockwise direction A. Without partition 50, air tends to build up over fan 38 because of the counterclockwise spin of fan 38 and fan 42. As previously discussed, this tendency has the undesirable effect of creating an uneven air curtain and leading to air flow fluctuations. To address this problem, refrigeration system 10 employs partition 50, which extends generally perpendicular from fan panel 40, which supports fans 38, 42. Partition 50 prevents turbulence from fan 42 from interfering with the flow of air through fan 38.

Figure 4:
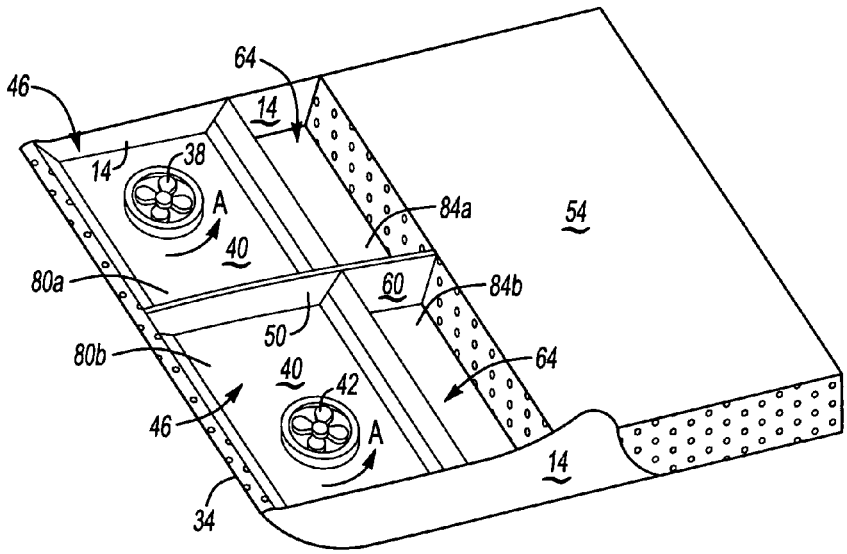
FIG. 4 illustrates a perspective view of first volume and second volume partitioned by first partition and second partition respectively.

As shown in FIG. 4, first volume 46 extends between air inlet 34, and fan panel 40 and is between the walls of display case 14. In addition, second volume 64 extends between fan panel 40 and cooling element 54. Partition 50 serves to divide first volume 46 into two separate chambers, chamber

80A and chamber 80B. Partition 60 serves to divide second volume 64 also into two chambers, chamber 84A and chamber 84B. Thus, air in chamber 80A and chamber 84A will not be affected by air in chamber 80B and chamber 84B. Partitions may also extend from cooling element 54 to air outlet 30 at the top of display case 14.

Because of these partitions, air drawn by fan 42 will not affect air drawn by fan 40. Air will not build up over one fan. In this way, partitions 50, 60 serve to promote a uniform air curtain without air fluctuation.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A refrigeration system comprising:

a display case having a viewing area with a first side and a second side;

an air outlet on said first side, guiding air across said viewing area;

an air inlet on said second side, receiving air from said air outlet;

at least a first fan and a second fan in communication with said air inlet;

a first volume extending between said air inlet and said first fan and second fan; and at least a first partition between said first fan and said second fan, dividing said first volume.

2. The refrigeration system of claim 1 including a cooling element spaced from said first fan and said second fan cooling air received from said air inlet.

3. The refrigeration system of claim 2 including a second partition between said first fan and said second fan extending into a second volume between said first fan and said second fan and said cooling element.

4. The refrigeration system of claim 1 including a first panel supporting said first fan and said second fan within said display case.

5. The refrigeration system of claim 4 wherein said first partition extends generally perpendicular from said first panel.

6. The refrigeration system of claim 4 including a second panel spaced from said first panel to define at least partially said first volume.

7. The refrigeration system of claim 1 wherein said first fan and said second fan spin in the same direction.

8. A refrigeration system comprising:

a display case having a viewing area with a first side and a second side;

an air outlet on said first side, guiding air across said viewing area;

an air inlet on said second side, receiving air from said air outlet;

at least a first fan and a second fan supported by a first panel, spinning in the same direction and in communication with said air inlet;

a cooling element spaced from said first fan and said second fan, cooling air received from said air inlet;

a first volume extending between said first fan and said second fan and said cooling element; and at least a first partition between said first fan and said second fan, dividing said first volume.

9. The refrigeration system of claim 8 including a second volume extending between said air inlet and said first fan and said second fan.

10. The refrigeration system of claim 9 including a second partition between said first fan and said second fan extending into a second volume between said first fan and said second fan and said air inlet.

11. The refrigeration system of claim 8 wherein said first partition extends generally perpendicular from said first panel.

12. The refrigeration system of claim 8 including a second panel spaced from said first panel to define at least partially said first volume.

13. A refrigeration system comprising:

a display case having a viewing area with a first side and a second side;

an air outlet on said first side, guiding air across said viewing area;

an air inlet on said second side, receiving air from said air outlet;

at least a first fan and a second fan in communication with said air inlet;

a cooling element spaced from said first fan and said second fan to at least partially defining a first volume, cooling air received by said air inlet;

at least a first partition between said first fan and said second fan, dividing said first volume.

14. The refrigeration system of claim 13 including a second volume extending between said air inlet and said first fan and second fan wherein said second volume is divided by a second partition between said first fan and said second fan.

15. The refrigeration system of claim 13 including a first panel supporting said first fan and said second fan within said display case.

16. The refrigeration system of claim 15 wherein said first partition extends generally perpendicular from said first panel.

17. The refrigeration system of claim 15 including a second panel spaced from said first panel to define at least partially said first volume.

18. The refrigeration system of claim 13 wherein said first fan and said second fan spin in the same direction.

* * * * *